US012055356B2

(12) United States Patent
Reel

(10) Patent No.: US 12,055,356 B2
(45) Date of Patent: Aug. 6, 2024

(54) MODULAR FIREARM MUZZLE DEVICE

(71) Applicant: Kaw Valley Precision LLC, Silver Lake, KS (US)

(72) Inventor: Ian Reel, Topeka, KS (US)

(73) Assignee: Kaw Valley Precision LLC, Silver Lake, KS (US)

( * ) Notice: Subject to any disclaimer, the term of this patent is extended or adjusted under 35 U.S.C. 154(b) by 0 days.

(21) Appl. No.: 17/109,234

(22) Filed: Dec. 2, 2020

(65) Prior Publication Data

US 2021/0172694 A1 Jun. 10, 2021

Related U.S. Application Data

(60) Provisional application No. 62/943,842, filed on Dec. 5, 2019.

(51) Int. Cl.

| | |
|---|---|
| ***F41A 21/36*** | (2006.01) |
| ***F41A 21/30*** | (2006.01) |
| ***F41A 21/32*** | (2006.01) |
| ***F41A 21/34*** | (2006.01) |

(52) U.S. Cl.

CPC ..... *F41A 21/36* (2013.01); *F41A 21/32* (2013.01); *F41A 21/325* (2013.01); *F41A 21/34* (2013.01)

(58) Field of Classification Search

None

See application file for complete search history.

(56) References Cited

U.S. PATENT DOCUMENTS

| | | | | | |
|---|---|---|---|---|---|
| 1,017,003 | A * | 2/1912 | Kenney | F41A 21/30 | 89/14.4 |
| 2,667,815 | A * | 2/1954 | Strong | F41A 21/36 | 89/14.3 |
| 4,307,652 | A * | 12/1981 | Witt | F41A 21/36 | 89/14.3 |
| 5,425,298 | A | 6/1995 | Coburn | | |
| 5,679,916 | A * | 10/1997 | Weichert | F41A 21/30 | 181/232 |
| 6,425,310 | B1 * | 7/2002 | Champion | F41A 21/30 | 89/14.3 |
| 7,870,815 | B2 * | 1/2011 | Hung | F41A 21/34 | 42/77 |
| 8,939,057 | B1 * | 1/2015 | Edsall | F41A 21/30 | 89/14.05 |

(Continued)

FOREIGN PATENT DOCUMENTS

| | | | | |
|---|---|---|---|---|
| GB | 2333826 A * | 8/1999 | ..... | F41A 21/30 |
| IT | VA920017 A1 | 1/1994 | | |

*Primary Examiner* — Derrick R Morgan

(74) *Attorney, Agent, or Firm* — Wood Herron & Evans LLP

(57) ABSTRACT

Provided is a modular firearm muzzle device having a multi-piece housing assembled from a plurality of substantially tubular, axially assemblable wall members that have a first interior cross-sectional size. A mounting member is mountable to a firearm muzzle. A forward wall has a central passageway that is aligned with the firearm muzzle and has a cross-section size smaller than the first cross-sectional size. The wall members are assembled with the mounting member and forward wall to define an interior chamber through which a projectile passes from the muzzle. The device can be assembled with fewer or more wall members to adjust the length of the interior chamber.

11 Claims, 7 Drawing Sheets

(56) References Cited

U.S. PATENT DOCUMENTS

| | | | | |
|---|---|---|---|---|
| 9,347,727 | B1 * | 5/2016 | Cler | F41A 21/30 |
| 9,500,427 | B1 * | 11/2016 | Larue | F41A 21/30 |
| 9,829,264 | B1 * | 11/2017 | Berglund | F41A 21/30 |
| 10,036,603 | B2 | 7/2018 | Maranli | |
| 10,480,888 | B2 * | 11/2019 | Barrett | F41A 21/28 |
| 10,852,091 | B1 * | 12/2020 | Helms | F41A 21/30 |
| 2012/0103176 | A1 * | 5/2012 | Latka | F41A 21/325 89/14.4 |
| 2012/0180624 | A1 * | 7/2012 | Troy | F41A 21/30 89/14.4 |
| 2012/0317855 | A1 * | 12/2012 | Butler | F41A 21/34 42/1.06 |
| 2016/0018177 | A1 * | 1/2016 | Powell | F41A 21/30 89/14.4 |
| 2017/0299312 | A1 * | 10/2017 | Llewellyn, Jr. | F41A 21/30 |
| 2018/0202742 | A1 * | 7/2018 | Brittingham | F41A 21/34 |
| 2018/0238653 | A1 * | 8/2018 | Kunsky | F41A 21/30 |
| 2018/0340750 | A1 * | 11/2018 | Mooty | F41A 21/34 |
| 2019/0242668 | A1 * | 8/2019 | Barrett | F41A 21/28 |
| 2019/0339036 | A1 * | 11/2019 | Edminster | F41A 21/30 |
| 2020/0217607 | A1 * | 7/2020 | Albright | F41A 21/38 |
| 2021/0041200 | A1 * | 2/2021 | Kras | F41A 21/30 |
| 2021/0116200 | A1 * | 4/2021 | Graham | F41A 21/30 |
| 2021/0299762 | A1 * | 9/2021 | Kunsky | B23B 49/02 |
| 2021/0341246 | A1 * | 11/2021 | Kunsky | F41A 21/30 |
| 2021/0381791 | A1 * | 12/2021 | Magee | F41A 21/30 |
| 2021/0389076 | A1 * | 12/2021 | Turnblom | F41A 21/36 |

* cited by examiner

MODULAR FIREARM MUZZLE DEVICE

CROSS-REFERENCE TO RELATED APPLICATION

This application claims priority to U.S. Provisional patent Application No. 62/943,842, filed Dec. 5, 2019, and incorporates the same herein by reference.

TECHNICAL FIELD

This invention relates to a muzzle device for a firearm that can operate as a recoil brake/compensator and/or for redirection of the muzzle blast and sound produced by it.

BACKGROUND

Various devices attach to the muzzle of a firearm barrel to enhance shooting performance. Muzzle breaks redirect a significant portion of the muzzle blast to reduce felt recoil. Other devices redirect a portion of the blast upward in order to reduce muzzle climb during repeat firing. Some linear compensators simply collimate or redirect the muzzle blasts forward. This concentrates the size of the muzzle flash in the shooter's line of sight and redirects a substantial portion of the sound forward, away from the shooter, although it does not reduce the overall sound level. Other compensators redirect a portion of the muzzle blast to reduce muzzle climb, but also include an interior surface or wall against which a significant portion of the muzzle blast impacts that may also reduce felt recoil.

Muzzle compensators, including linear compensators, of any particular type are often made in various sizes to accommodate different levels of muzzle blast determined by the load and/or caliber of ammunition being used.

SUMMARY OF THE INVENTION

The present invention provides a linear compensator in which the housing body is made of separable and reconfigurable parts, so the user can select the volume and length of the compensator to match the ammunition load and/or caliber being used.

The modular firearm muzzle device has a multi-piece housing assembled from a plurality of substantially tubular, axially assemblable wall members that have a first interior cross-sectional size. A mounting member is mountable to a firearm muzzle. A forward wall has a central passageway that is aligned with the firearm muzzle and has a cross-section size smaller than the first cross-sectional size. The wall members are assembled with the mounting member and forward wall to define an interior chamber through which a projectile passes from the muzzle. The device can be assembled with fewer or more wall members to adjust the length of the interior chamber.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein:

FIG. 7 is a side sectional assembled view of the device shown in figs for.

DETAILED DESCRIPTION

Figure 1:
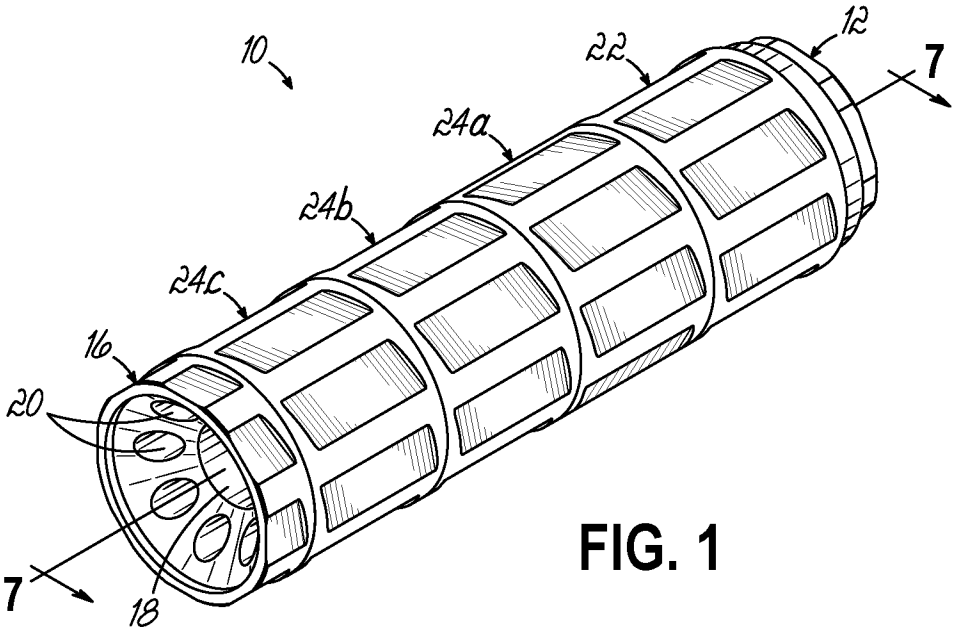
FIG. 1 is an isometric view of a modular linear compensator according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

As used herein, "forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner. As used herein, "firearm" includes air guns and other devices that fire a projectile through the muzzle of a barrel, even is not defined as a "firearm" under state or federal laws.

Figure 2:
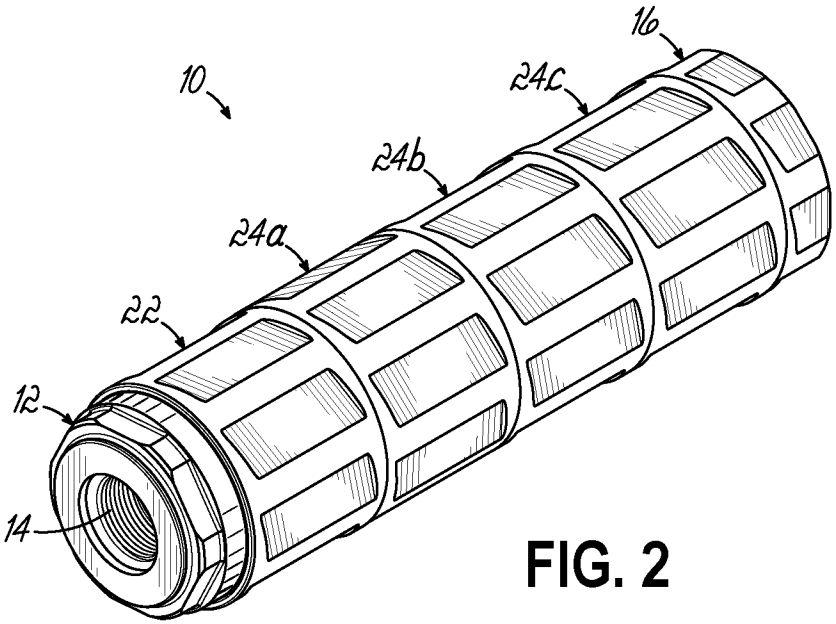
FIG. 2 is an alternate (from the rear) isometric view thereof.
Figure 3A:
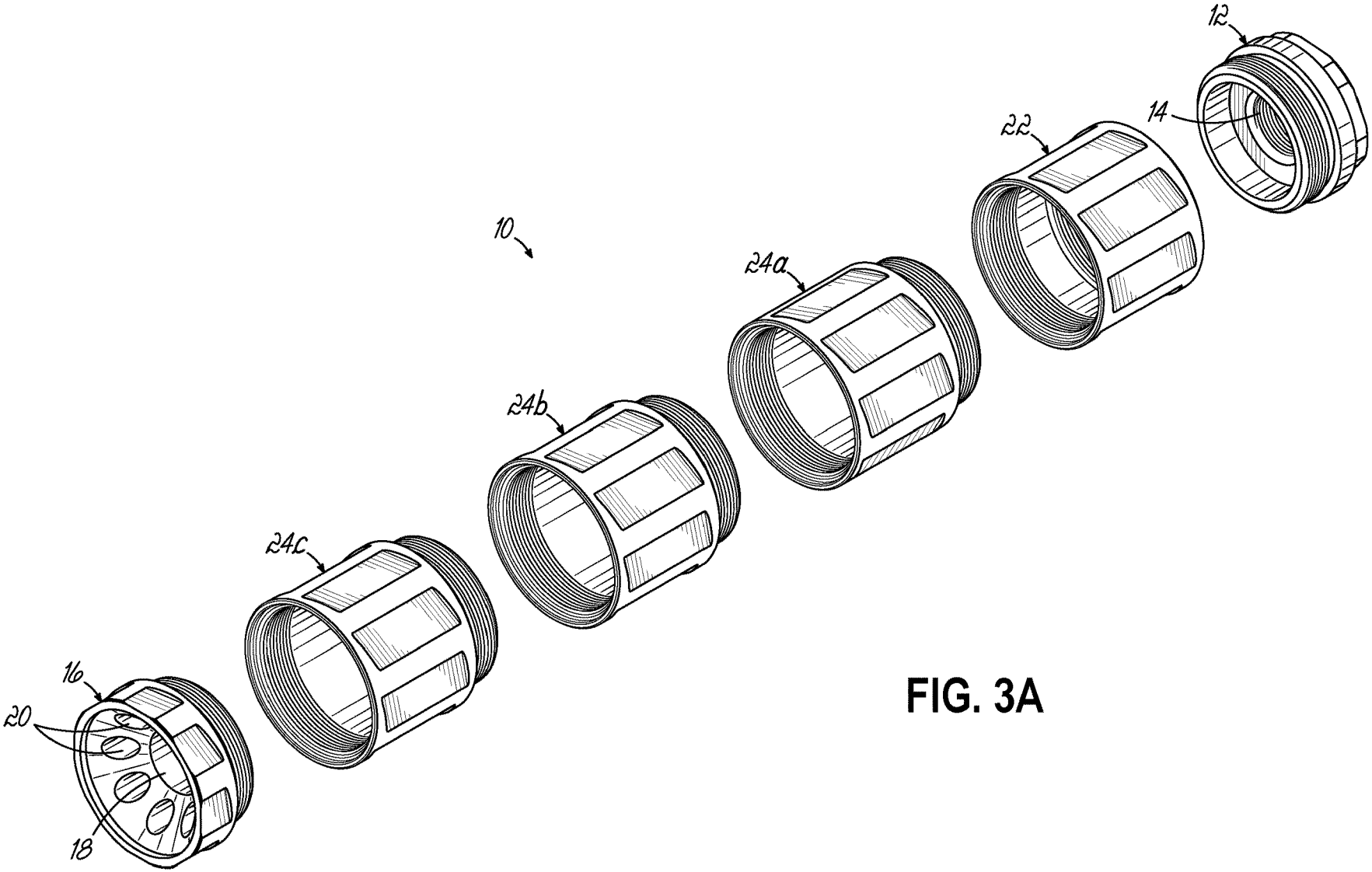
FIG. 3A is an exploded isometric view thereof.
Figure 3B:
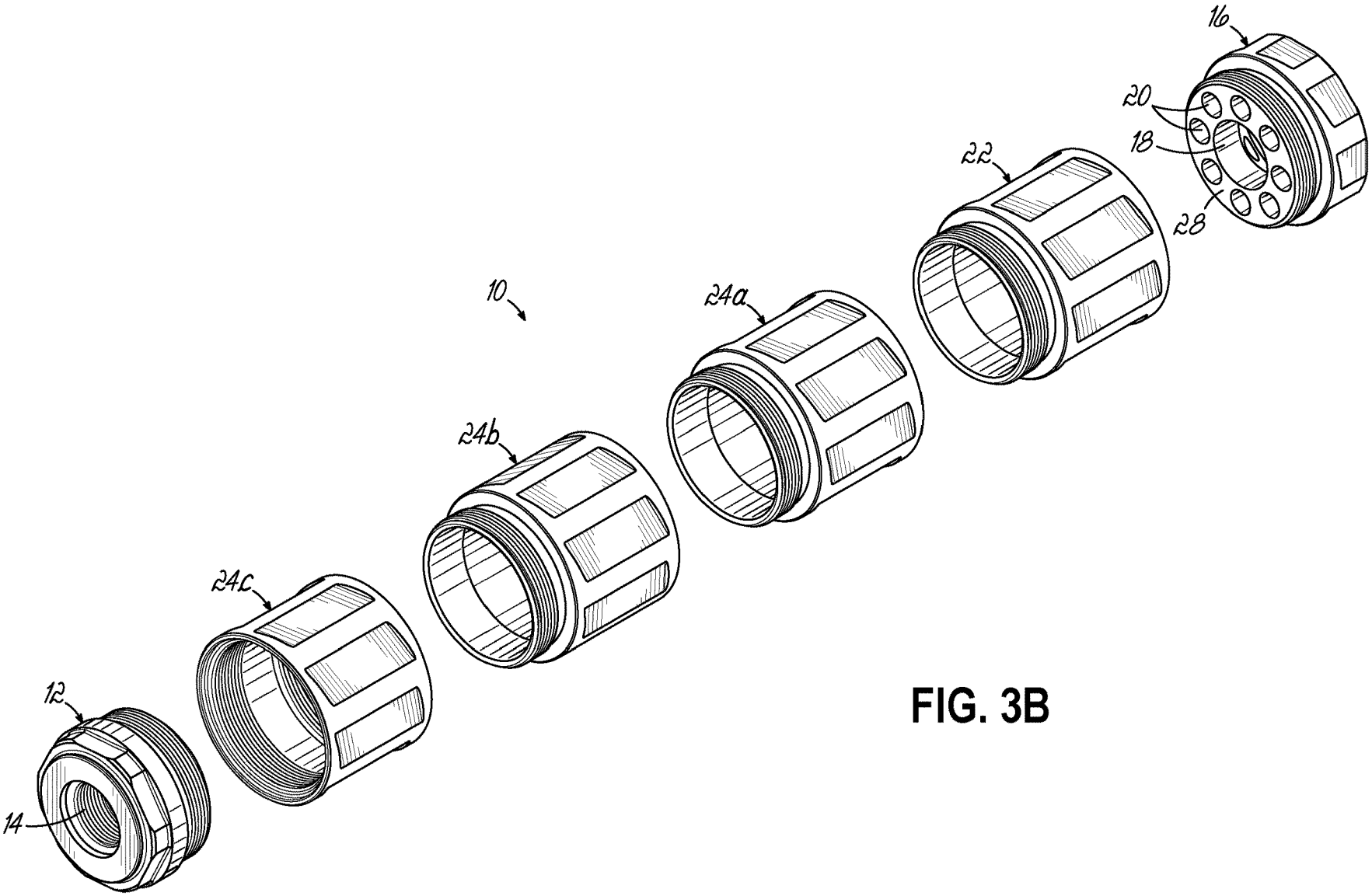
FIG. 3B is an alternate isometric view thereof.

Referring first to FIGS. 1 and 2, therein is shown a modular compensator 10 according to one embodiment of the present invention. As also shown in FIGS. 3A and 3B, the compensator 10 includes an attachment unit 12 that may be threaded 14 or otherwise configured for direct or quick-attach/-detach from the muzzle of a firearm barrel (not shown in FIGS. 1 and 2). At the forward end is a foreword end unit 16 that includes an axially centered opening 18 and a series of radially situated secondary openings 20, which will be described in further detail later. Between the attachment unit 12 and forward and unit 16 are one or more separable housing units 22. If desired, heat resistant O-rings (not shown) can be used between some or all of the connections.

Figure 4:
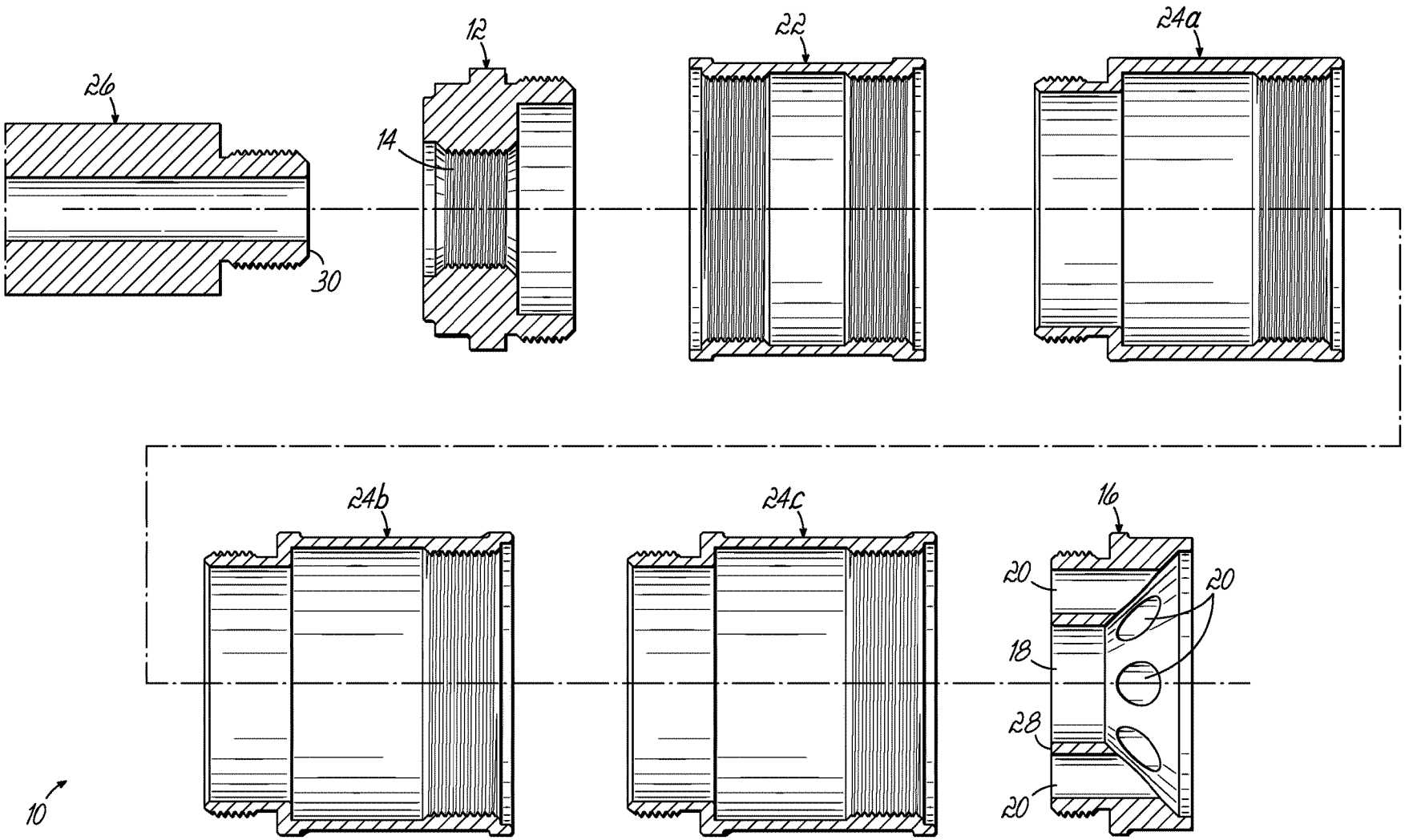
FIG. 4 is an exploded side sectional view thereof showing the base portion of a firearm barrel.
Figure 7:
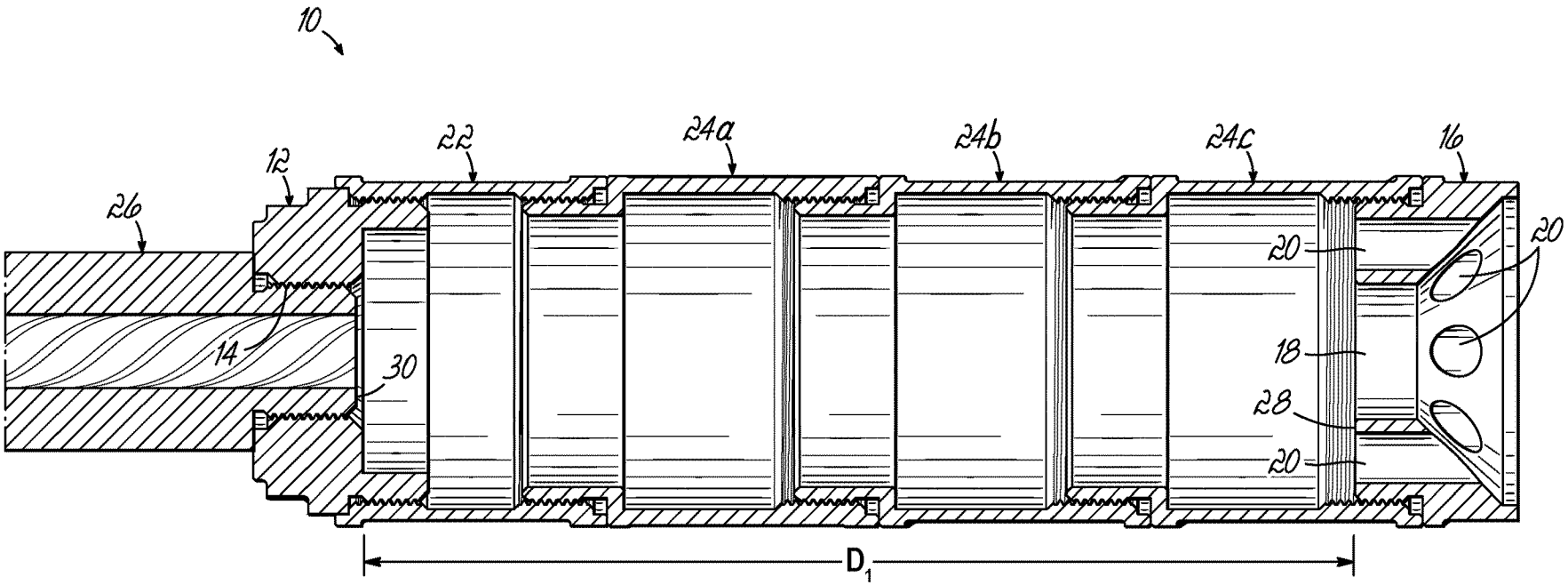

Referring now to FIGS. 4 and 7, therein are seen exploded and assembled side sectional views of the compensator 10 mounted on the muzzle end of a barrel 26. When a projectile (not shown) exits the barrel 26, it passes through the housing units 22, 24*a-c*, and through the axial opening 18 of the forward end unit 16. The muzzle blast/flash, which comprises high pressure gases, follows the projectile and expands within the interior chamber defined by the housing units 22, 24*a-c*, and then vents through the axial opening 18 and secondary openings 20 in the forward end unit 16. These openings collimate the flow of pressurized gas and direct them forward, in the direction that the projectile flies and away from the firearm and user holding it. At least some portion of the muzzle blast impacts the rear surface 28 of the forward end unit 16 around the axial opening 18 and between the secondary openings 20.

Figure 5:
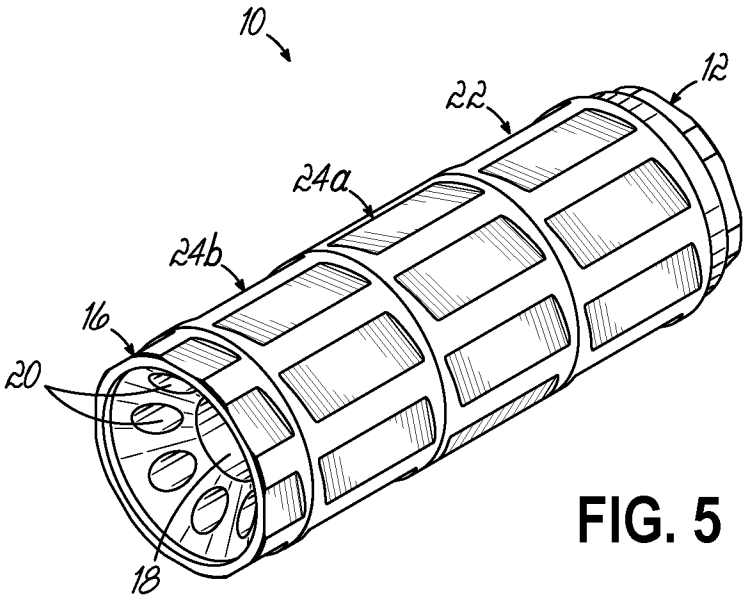
FIG. 5 is an isometric view of the device shown in a first alternate configuration.
Figure 6:
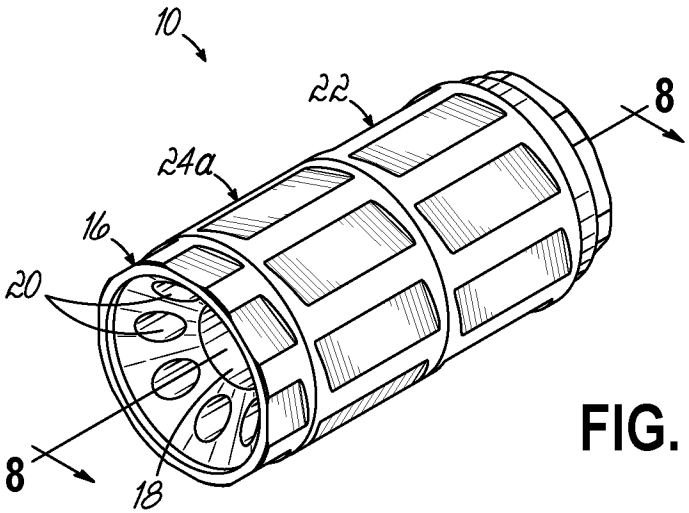
FIG. 6 is an isometric view showing a second alternate configuration thereof.
Figure 8:
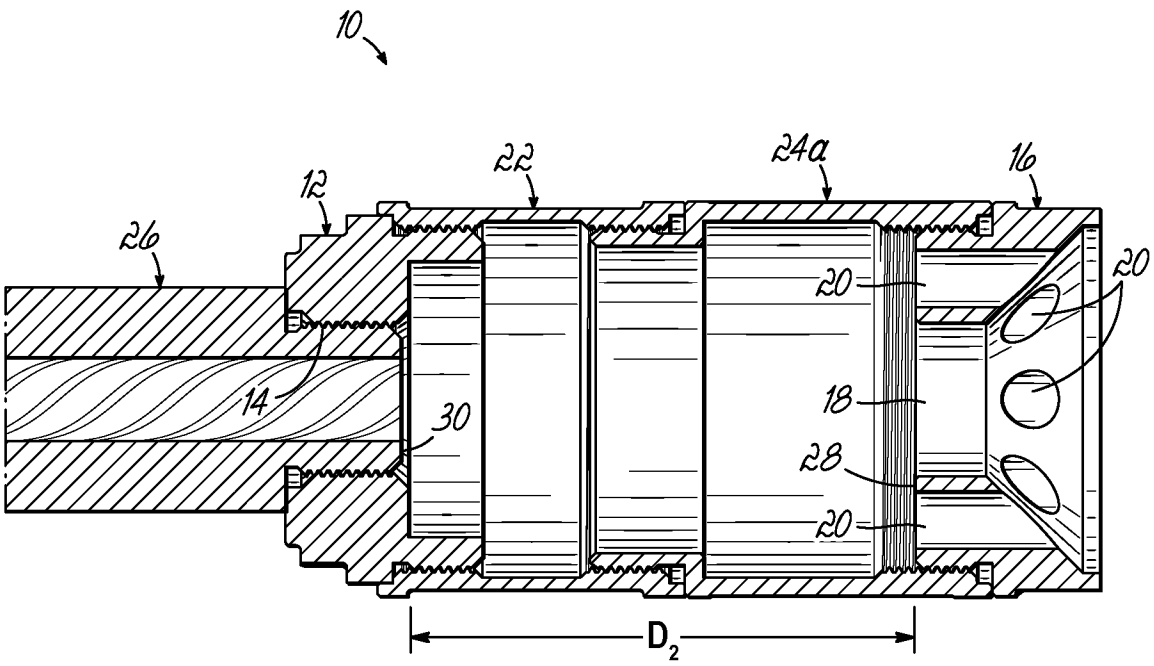
FIG. 8 is a side sectional view of the configuration shown in FIG. 6 taken substantially along line 8-8 of FIG. 6.

To maximize performance of the compensator 10, the volume of the chamber formed within the housing units 22, 24*a-c* and the distance Dx from the muzzle 30 to the rear surface 28 of the forward end unit 16 are correspondingly selected. For certain ammunition types and calibers, a longer and larger volume compensator is desired, where other ammunition calibers and loads or types may perform at least as well or better in a shorter, smaller volume compensator. According to one aspect of the illustrated embodiment, the compensator 10 may be assembled using all or only some of the extension housing units 24*a-c*. For example, the compensator 10 illustrated in FIGS. 1-4 and 7 include the coupling housing unit 22 and three extension housing units 24*a-c*. FIGS. 5, 6, and 8 illustrate other combinations using only two (FIGS. 5 and 8) or one (FIG. 6) extension housing unit 24*a* and/or 24*b*. The compensator 10 can be assembled using only the attachment unit 12, coupling housing unit 22 and forward end unit 16, although this embodiment/combination is not specifically illustrated. FIG. 7 illustrates one combination with a first volume and distance D1. FIG. 8 illustrates an alternate combination with a smaller volume and shorter distance D2.

The threaded engagements between the housing units 22, 24*a-c* allow the user to select the length and interior volume of the compensator 10. The coupling housing unit 22 includes female threads on both axial ends so as to connect with the corresponding male threads of the attachment unit 12 and forward end unit 16. The extension housing units 24*a-c* have male threads at one axial end and corresponding female threads at the opposite axial end. Flat surfaces on the attachment unit 12, forward end unit 16, and housing units 22, 24*a-c* allow a wrench or other tool to be used to assist in disassembly.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A modular firearm muzzle device comprising:

a brake or a compensator that directs propellant gas forward, the brake or compensator comprising:

a baffle-less multi-piece housing assembled from a plurality of substantially tubular, axially assemblable wall members having a first interior cross-sectional size;

a mounting member mountable to a firearm muzzle; and a forwardmost end unit having a central passageway, the central passageway being aligned with the firearm muzzle, the central passageway having a forward portion that is conical in cross-section and an aft portion that is cylindrical in cross-section, the aft portion having an internal diameter that is smaller than the first interior cross-sectional size, the forward portion having an aft internal diameter and a forward internal diameter, the aft internal diameter being equal to the internal diameter of the aft portion and the forward internal diameter being greater than the aft internal diameter, the forwardmost end unit further including a plurality of forwardly directed secondary passageways that are cylindrical in cross-section and positioned radially outward from, and spaced circumferentially around, the central passageway, the secondary passageways commencing at an aftmost end of the forwardmost end unit and terminating forward of an aftmost end of the forward portion of the central passageway and aft of a forwardmost end of the forward portion of the central passageway, wherein the wall members are assembled with the mounting member and forwardmost end unit to define a single, undivided interior chamber through which a projectile passes from the muzzle.

2. The muzzle device of claim 1, wherein the wall members are imperforate when assembled.

3. The muzzle device of claim 1, wherein the mounting member is integral with one tubular wall member.

4. The muzzle device of claim 1, wherein the forwardmost wall end unit includes male threads that engage female threads of one tubular wall member.

5. The muzzle device of claim 1, wherein the mounting member includes male threads that engage female threads of a tubular wall member.

6. The muzzle device of claim 1, wherein the tubular wall members include complementary threads for disassemblable attachment.

7. The muzzle device of claim 1, further comprising at least a third tubular wall member.

8. A modular firearm muzzle device comprising:

a brake or a compensator that directs propellant gas forward, the brake or compensator comprising:

a mounting member for attachment to a firearm muzzle; and a plurality of tubular housing units selectively assemblable to and between the mounting member and a forwardmost end member to form a baffle-less multi-piece housing having a first interior cross-sectional size; the forwardmost end member having a central passageway, the central passageway being aligned with the firearm muzzle, the central passageway having a forward portion that is conical in cross-section and an aft portion that is cylindrical in cross-section, the aft portion having an internal diameter that is smaller than the first interior cross-sectional size, the forward portion having an aft internal diameter and a forward internal diameter, the aft internal diameter being equal to the internal diameter of the aft portion and the forward internal diameter being greater than the aft internal diameter, the forwardmost end member further including a plurality of forwardly directed secondary passageways that are cylindrical in cross-section and positioned radially outward from, and spaced circumferentially around, the central passageway, the secondary passageways commencing at an aftmost end of the forwardmost end member and terminating forward of an aftmost end of the forward portion of the central passageway and aft of a forwardmost end of the forward portion of the central passageway;

wherein, when assembled, the mounting member, forwardmost end member, and tubular housing units are configured to define a single, undivided internal blast chamber.

9. The muzzle device of claim 8, further comprising at least a third tubular housing unit selectively assemblable between adjacent housing units.

10. The muzzle device of claim 1, wherein the wall members, mounting member, and forwardmost end unit are configured to form a linear compensator.

11. The muzzle device of claim 8, wherein the mounting member, forwardmost end member, and tubular housing units are configured to form a linear compensator.

* * * * *